US005293665A

United States Patent [19]

Wörwag

[11] Patent Number: 5,293,665

[45] Date of Patent: Mar. 15, 1994

[54] NOZZLE MECHANISM FOR A VACUUM CLEANER

[75] Inventor: Peter Wörwag, Romanshorn, Switzerland

[73] Assignee: Firma Fedag, Romanshorn, Switzerland

[21] Appl. No.: 839,326

[22] Filed: Feb. 19, 1992

[30] Foreign Application Priority Data

Feb. 19, 1991 [DE] Fed. Rep. of Germany ..... 4105012

[51] Int. Cl.[5] ..... A47L 9/04

[52] U.S. Cl. ..... 15/387; 15/328

[58] Field of Search ..... 15/387, 328

[56] References Cited

U.S. PATENT DOCUMENTS 3,688,339 9/1972 Vincent et al. ..... 15/387

FOREIGN PATENT DOCUMENTS 3414862 11/1985 Fed. Rep. of Germany ..... 15/387

*Primary Examiner*—Chris K. Moore

*Attorney, Agent, or Firm*—Robert W. Becker & Associates

[57] ABSTRACT

A nozzle mechanism for a vacuum cleaner. The mechanism has a sliding base with an intake opening, and a suction conduit connector for a vacuum cleaner. Disposed between the intake opening and the connector is an air feed channel, in the path of which is disposed a turbine chamber having a turbine that can be driven by intake air. The turbine serves for driving a brush roller for mechanically cleaning floors. A second intake opening is provided that is connected to the turbine chamber via an intake channel that is independent of the first intake opening. The air for driving the turbine is supplied to the turbine chamber at least partially via the second intake opening and the intake channel.

13 Claims, 6 Drawing Sheets

NOZZLE MECHANISM FOR A VACUUM CLEANER

BACKGROUND OF THE INVENTION

The present invention relates to a vacuum cleaner nozzle mechanism having a sliding base with a suction or intake opening, a suction conduit connecting means for a vacuum cleaner, an air feed channel for establishing communication between the intake opening and the connecting means, and a turbine that is driven by drawn-in air and serves to drive a brush roller that is rotatably mounted in the vicinity of the intake opening.

Not only for the vacuum cleaning of textile floor coverings, but also for cleaning smooth floor surfaces, the force of the air stream that is flowing into the vacuum cleaner nozzle mechanism is not adequate for loosening dirt particles that adhere to the surface that is to be cleaned. For this reason, a mechanical action, preferably via a rotating brush, is necessary, especially for cleaning textile floor coverings. This rotating, roller-like brush can be driven not only by an electric motor as well as by a friction gear, or by an air turbine. Where an air turbine is used, the intake air stream that flows through the nozzle mechanism is utilized to drive the turbine wheel, which is mounted in a turbine chamber. The rotation of the turbine wheel is transferred directly to the roller brush via a belt drive. Driving the rotating brush roller via an air turbine is particularly advantageous, since air turbines have a very straightforward construction and hence are very economical, and the air stream that is required for driving the turbine is available as the intake or suction air stream. In contrast, with an electric drive system, in addition to the expense for the electric motor, there also exists the problem of not only providing power from the vacuum cleaner to the nozzle mechanism, but also doing so in an absolutely safe manner.

These reasons have led to the significant use of air turbines for driving the rotating brush roller. Unfortunately, heretofore known vacuum cleaner nozzle mechanisms have the shortcoming that the drive power of the air turbine is frequently significantly reduced due to the fact that the intake opening of the nozzle mechanism rests very tightly i.e. in a nearly sealing manner on the floor surface that is to be cleaned, especially with textile floor coverings, thereby greatly reducing the suction or intake air stream that is trying to flow in. In addition, the contact pressure of the nozzle mechanism against the surface that is to be cleaned is increased by the partial vacuum that builds up in the suction region, as a result of which the intake air stream that is flowing in through the suction or intake opening is restricted even further, so that the turbine wheel, and hence the brush roller that is to be rotated, frequently cease to rotate, thereby preventing any mechanical cleaning action.

With the heretofore known vacuum cleaner nozzle mechanisms that have a rotating brush roller, the speed of the rotating brush roller can be varied, even to the point of stopping the roller, by deflecting the air stream that is flowing onto the turbine wheel.

Due to the forward and backward operating movements of the nozzle mechanism during a cleaning process on the floor surface that is to be cleaned, and due to the often varying surface condition and density of the textile floor covering, the intake air stream that is flowing through the suction or intake opening into the nozzle mechanism constantly fluctuates, as a consequence of which the rotational performance of the brush roller, and hence the cleaning capacity thereof, is unsatisfactory, which the person that is operating the vacuum cleaner frequently cannot immediately recognize.

It is therefore an object of the present invention to provide a vacuum cleaner nozzle mechanism of the aforementioned general type that, regardless of the floor condition and the distance between the sliding base and the floor, always allows an adequate suction or intake air stream to flow in for driving the air turbine in the turbine chamber.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
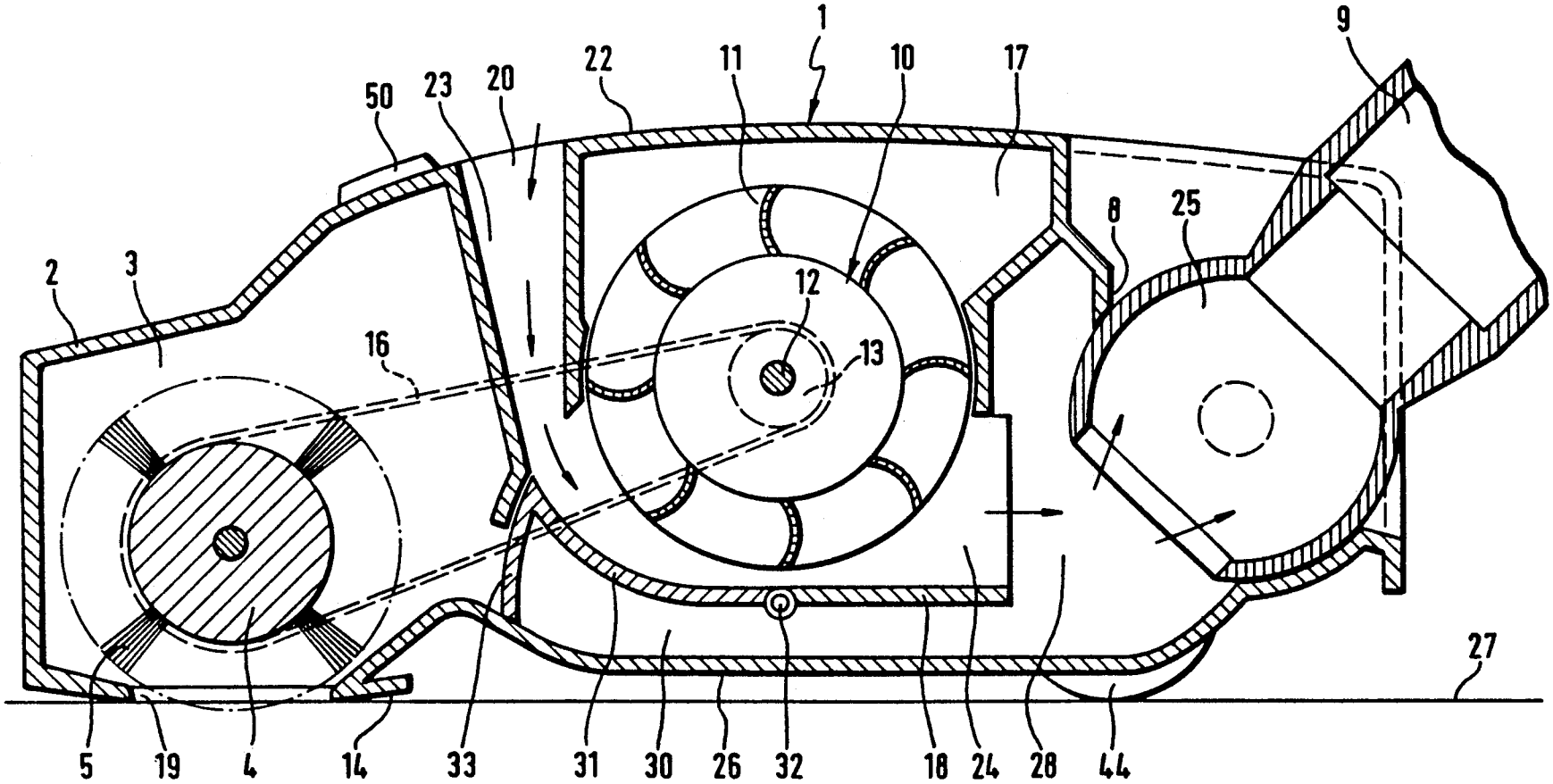
FIG. 1 is a longitudinal cross-sectional view through a first exemplary embodiment of the inventive nozzle mechanism in the operating state of the rotating turbine.

The nozzle mechanism of the present invention is characterized primarily in that a second suction or intake opening is provided, with an intake channel that is independent of the first intake opening establishing communication between the second intake opening and a turbine chamber for the turbine, with the air for driving the turbine being supplied to the turbine chamber at least partially via the second intake opening and the intake channel.

Pursuant to the present invention, the drive for the air turbine can now be established independently of the intensity of the dust-laden intake air stream through the first intake opening. This simplifies handling of the nozzle mechanism and improves the cleaning effect.

As a further feature of the present invention, a discharge channel can lead from the turbine chamber into a connection chamber that, when viewed in the direction of air flow, is disposed directly ahead or upstream of the suction conduit connecting means. As a result of this arrangement, short air paths that are free of deflections and have little resistance to flow are possible.

Pursuant to a first specific embodiment of the present invention, the air feed channel for the dust-laden air bypasses the turbine chamber and opens into the connection chamber, so that the turbine chamber always receives intake air from the atmosphere and no dust-laden air. This keeps the air turbine from getting very dirty.

Pursuant to another specific embodiment of the present invention, the air feed channel that conveys the dust-laden air is disposed between the first intake opening and the turbine chamber and opens out into the turbine chamber on the same side as does the intake channel from the second intake opening. This offers the possibility for being able to supply to the turbine not only relatively clean ambient air but also dust-laden intake air.

To control the turbine drive and also to achieve a certain type of cleaning, for example for working cleaning foam or other fluid into a carpet, it is expedient to dispose valve means in the flow path of the intake channel and/or of the air feed channel or connecting channel. These valve means can be embodied in such a way that a reduction of the flow-through cross-section of the intake channel effects a commensurate widening of the flow-through cross-section of the air feed channel or connecting channel. These measures ensure that the air turbine always receives a sufficient air stream for driving the brush roller.

Alternatively, the valve means can be embodied in such a way that the flow-through cross-section of the intake channel and of the air feed channel can be controlled independent of one another. A simple construction with a reliable operation can be achieved by embodying the valve means as a flat slide mechanism that is movable transverse to the connecting channel. Alternatively, the valve means can be embodied as a piece that is pivotable along part of an arc, with this piece selectively blocking or freeing one or the other air passage.

Pursuant to a third exemplary embodiment of the inventive nozzle mechanism, not only the intake channel of the second intake opening, but also the air feed channel for the dust-laden air, extend nearly tangentially through the turbine chamber. This makes it possible to achieve an extremely uniform introduction of force with great efficiency, relative to the periphery of the turbine wheel. In this connection, it is advantageous for the intake channel to have a portion that exits the turbine chamber and opens out into the brush chamber. The air stream that passes through the intake channel and into the brush chamber flows about the brush roller, thereby taking along dirt particles that are disposed between the bristles and then passing together with the dust-laden air through the air feed channel to the connection chamber.

The turbine advantageously comprises two turbine chambers, each of which is provided with a turbine wheel, with one turbine wheel being supplied with a drive air stream via the intake channel, and with the other turbine wheel being supplied with the dust-laden stream. This arrangement, in conjunction with appropriate valve means for the individual air streams, forms a variety of control possibilities for the brush drive. To indicate to the operator the respective operating state of the brush roller, an electric generator that can be driven by the turbine is preferably provided, with this generator activating a visual or audible indicating means.

Further specific features of the present invention will be described in detail subsequently.

DESCRIPTION OF PREFERRED EMBODIMENTS

Referring now to the drawings in detail, the vacuum cleaner nozzle mechanism 1 illustrated in FIG. 1 is provided in its forward region, on the underside 26 and in a so-called sliding base 14, with a first suction or intake opening 19 through which extend the bristles 5 of a brush roller 4 that is disposed in a brush chamber 3. The brush roller 4 is rotatably mounted and can be driven by a turbine 10 via a drive belt 16. From the first intake opening 19, i.e. the brush chamber 3 in which this intake opening is disposed, extends an air feed channel 30 for the dust-laden air; this channel 30 is disposed in the lower region of the nozzle mechanism 1, and opens out into a connection chamber 28 that in the direction of air flow is disposed immediately ahead of a suction conduit receiving means 8, which accommodates a connector 9. This connector has a roller-like pivot head 25, with the receiving means 8 having a complementary configuration in order to be able to establish an articulated connection with the pivot head.

Disposed above a partition 18 that delimits the air feed channel 30 is a turbine chamber 17 in which the turbine wheel 11 of the air turbine 10 is mounted on a rotatable shaft 12. When viewed in a direction toward the brush chamber 3, the partition 18 continues in the form of a movable wall means 31 that is pivotable to a limited extent about a pivot axis 32; at its forward end, the wall means 31 is provided with a piece 33, here curved, that serves as a closure member and hence as a valve means for the air feed channel 30. Provided at the upper side 22 of the nozzle mechanism 1 is a second suction or intake opening 20, from where an intake channel 23 leads to the turbine chamber 17; the opening of the intake channel 23 to the turbine chamber 17 is disposed in such a way that due to the contour of the movable wall means 31, the air stream is directed very efficiently onto the turbine wheel 11. At the outlet side, the turbine chamber 17 is provided with a discharge channel 24 that leads into the connection chamber 28.

As can furthermore be seen from FIG. 1, disposed on the shaft 12 of the turbine wheel 11 is a belt pulley 13 for driving the drive belt 16 and causing the brush roller 4 to rotate. The nozzle mechanism 1 is provided on its underside with rollers 44 to facilitate a gliding movement over a floor surface 27. Provided on the upper side 22 of the nozzle mechanism 1 is a visual or audible indicating means 50 for indicating to an operator whether or not the brush roller 4 is rotating. The indicating means 50 is preferably connected to a non-illustrated generator that is driven by the turbine 10, for example via the drive belt 16 and a belt pulley provided on the generator.

Figure 2:
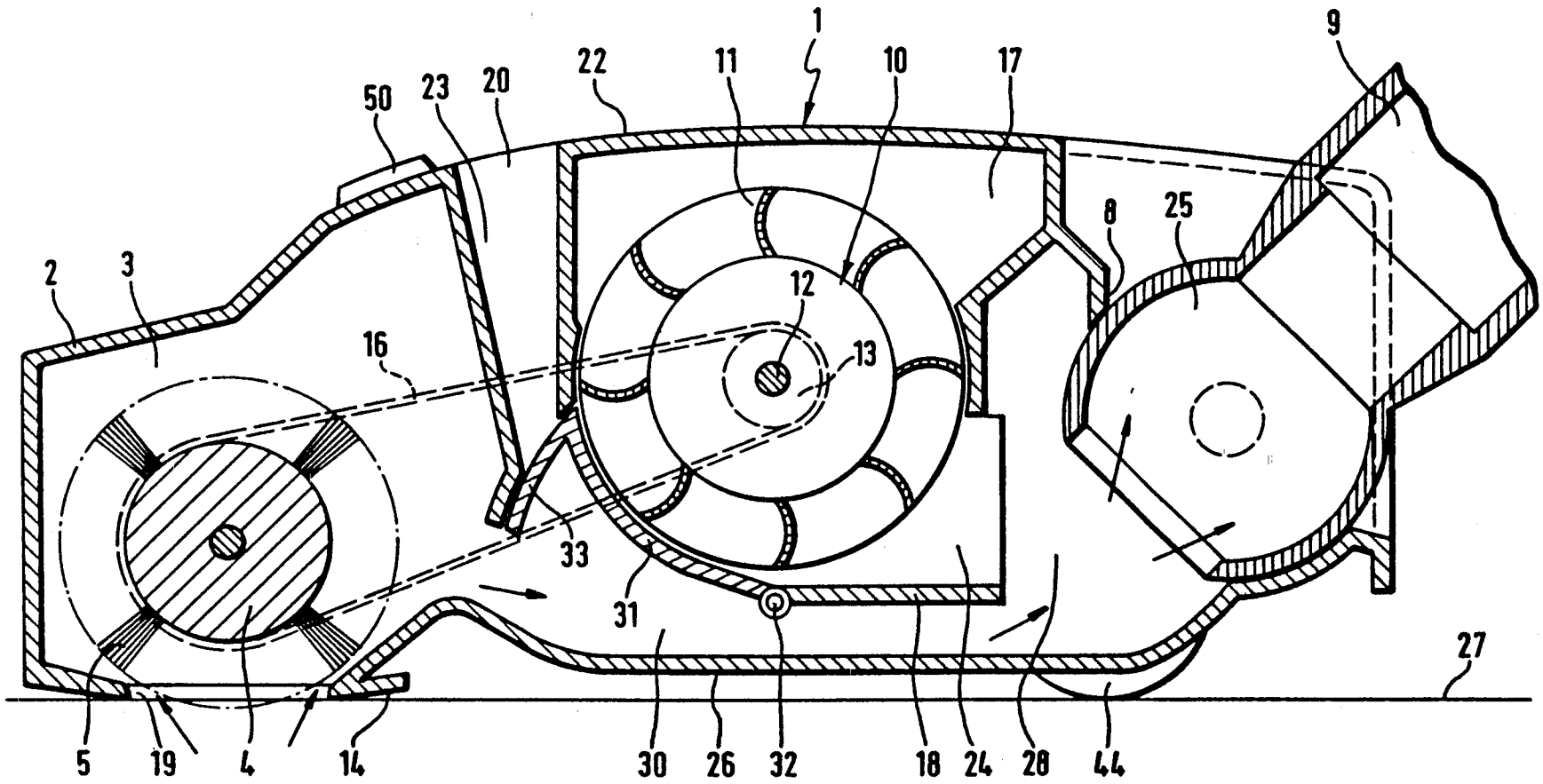
FIG. 2 is a cross-sectional view similar to that of FIG. 1, yet with the turbine at rest.

FIG. 2 shows a vacuum cleaner nozzle mechanism 1 that structurally corresponds to that illustrated in FIG. 1. Therefore, the same reference numerals are used for components that correspond to those of the embodiment of FIG. 1. In contrast to FIG. 1, in FIG. 2 the movable wall means 31 with its piece 33 is disposed in an upper position where they have been pivoted about the pivot axis 32; in this position, the piece 33 releases the passage between the brush chamber 3 and the air feed channel 30, while at the same time closing off the passage from the intake channel 23 to the turbine chamber 17. In the manner of operating the nozzle mechanism 1 illustrated in FIG. 2, the entire intake air stream is guided through the first intake opening 19, the brush chamber 3, the air feed channel 30, the connection chamber 28, and into the connector 9. Since air does not flow through the turbine chamber 17, the turbine wheel 11 does not turn, so that the brush roller 4 is not driven. This manner of operation can be used where loose dirt is found on the floor surface 27, because in such an instance no assistance is needed to loosen the dirt with the aid of the bristles 5 that are disposed on the brush roller 4.

The manner of operation for the nozzle mechanism 1 illustrated in FIG. 1 is particularly suitable for cleaning very dirty floor surfaces 27. In order to loosen the dirt of such surfaces, for example carpets, an intensive action of the bristles is required, and it may also be necessary to work cleaning foam or similar fluid into the carpet with the aid of the brush roller 4. During this operating process, an intake air stream through the first opening 19 is not desired, since this would result in vacuuming-up the cleaning foam before it would have a chance to effectively loosen the dirt. Therefore, the entire intake air stream is drawn in through the second intake opening 20 on the upper side 22 of the nozzle mechanism 1 and is guided through the intake channel 23 into the turbine chamber 17. As a consequence of the form of the movable wall means 31 and the partition 18, the air stream is guided onto the blades of the turbine wheel 11 and drives the turbine 10. Via the discharge channel 24, the air stream enters the connection chamber 28, from where it is conveyed through the connector 9 into the non-illustrated vacuum cleaner. As a result of the rotation of the turbine wheel 11, on the shaft 12 of which the belt pulley 13 is also mounted, the drive belt 16 is driven, thereby in turn rotating the brush roller 4.

Figure 3:
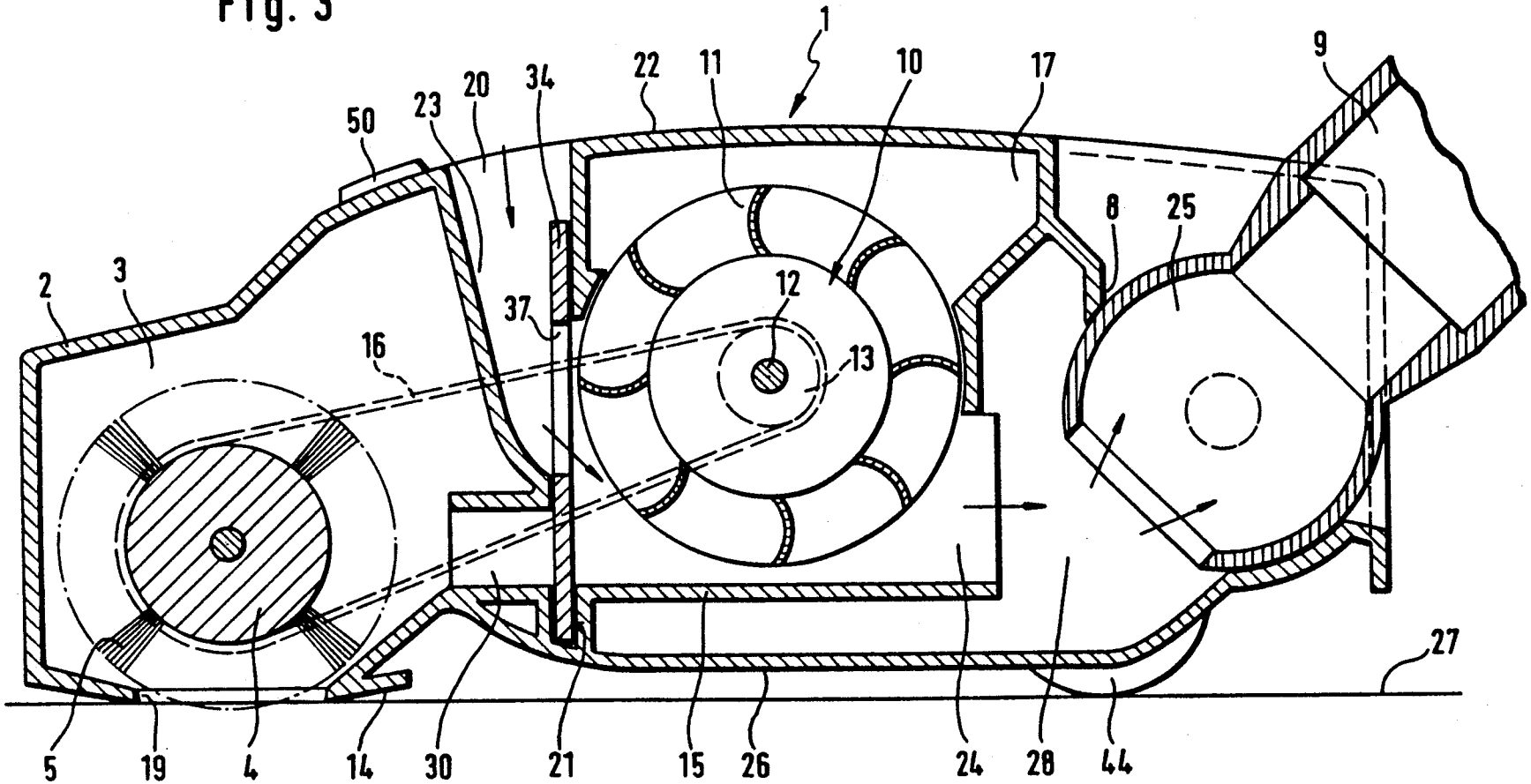
FIG. 3 is a cross-sectional view through a second exemplary embodiment of the inventive nozzle mechanism, with the channel for the dust-laden stream being blocked off.

FIG. 3 illustrates a second exemplary embodiment of the vacuum cleaner nozzle mechanism 1, with the upper side 22 and underside 26 thereof, as well as the forward region 2 and the suction conduit receiving means 8 and connector 9, which is mounted in the receiving means 8 via the pivot head 25, corresponding with the embodiment shown in FIGS. 1 and 2. The differences between the embodiments concern the inner construction and the manner of operation, although not with regard to the turbine 10 and its drive mechanism for the brush roller 4.

In contrast to the previously described embodiment, in the embodiment of FIG. 3 the brush chamber 3 is connected via the air feed channel 30 to the turbine chamber 17. The opening through which the air stream can enter the turbine chamber 17 from the air feed channel 30 is disposed in the same plane as is the opening through which the air stream from the intake channel 23 enters the turbine chamber 17. Disposed transverse to the flow-through direction is a slide mechanism 34, the guide path of which extends from the upper side 22 of the nozzle mechanism 1 to the underside 26 thereof. The bottom end of the guide path is formed by a slot or groove 21 that is disposed in the forward region of a lower turbine chamber wall 15. The slide mechanism 34 is provided with an opening 37 that, depending upon the position of the slide mechanism, acts as an adjustable orifice plate for the through passage from the intake channel 23 to the turbine chamber 17.

Figure 4:
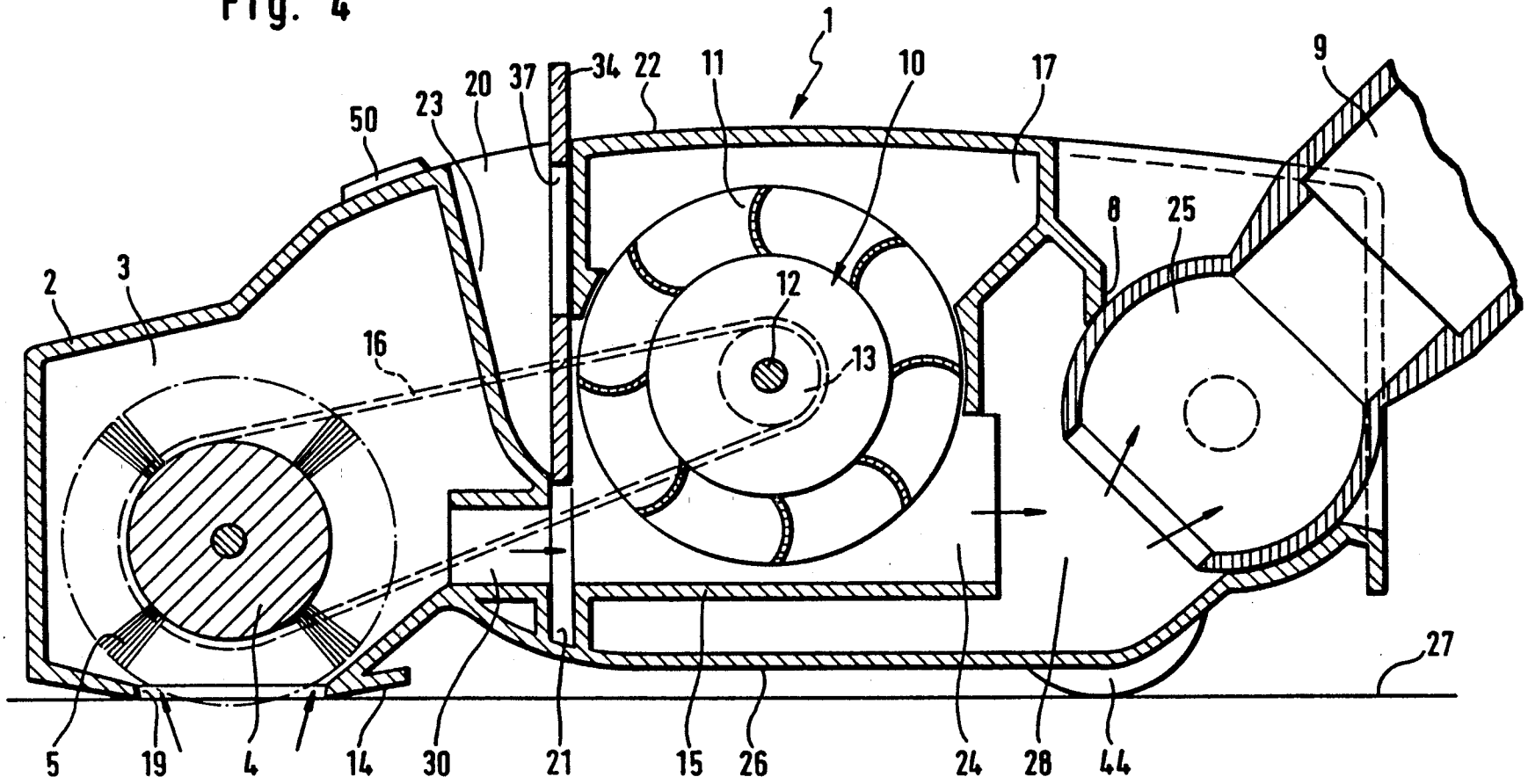
FIG. 4 is a view similar to that of FIG. 3, yet with the channel for the dust-laden stream being opened.

Whereas FIG. 3 shows the second embodiment of the vacuum cleaner nozzle mechanism in the operating position for full air passage through the second intake opening 20, in FIG. 4 the slide mechanism 34 is in a position where the opening 37 is completely covered and hence no intake air can enter through the intake channel 23. However, in this position the bottom end of the slide mechanism 34 releases the entire cross-sectional area of the air feed channel 30, so that the intake air can pass through the first intake opening 19, the brush chamber 3, the air feed channel 30, the turbine chamber 17, the discharge channel 24, the connection chamber 28, and into the connector 9.

Whereas with the embodiment illustrated in FIGS. 1 and 2 the turbine 10 can be varied and even completely shut off from intake air depending upon the position of the piece 33, with the embodiment illustrated in FIGS. 3 and 4 the turbine 10 is always supplied with an air stream, although the proportion of the air streams entering through the intake channel 23 and/or the air feed channel 30 can be adjusted with the aid of the slide mechanism 34. Thus, this second embodiment shows a nozzle mechanism 1 where the turbine 10 is always driven and the brush roller 4 always rotates regardless of the position of the slide mechanism 34. The lower slide mechanism position shown in FIG. 3 provides the possibility for blocking the intake air stream through the first intake opening 19 for certain operations, for example for working cleaning foam into a carpet.

Figure 5:
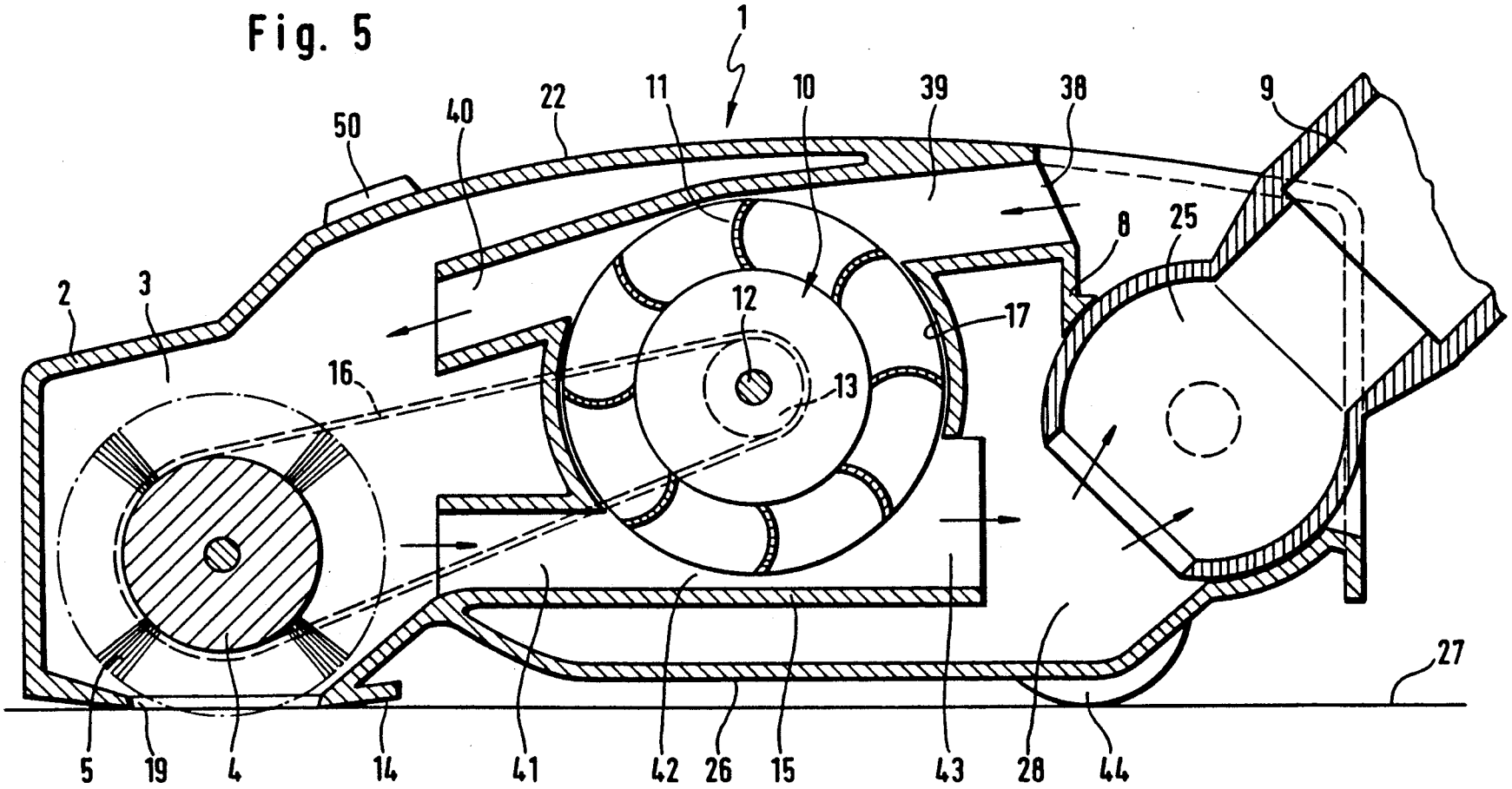
FIG. 5 shows a third exemplary embodiment of the inventive nozzle mechanism with a double air turbine through which air flows.

A third exemplary embodiment of the vacuum cleaner nozzle mechanism 1 is illustrated in FIG. 5. In this embodiment, the forward region 2 of a nozzle mechanism 1 and the rear region with the suction conduit receiving means 8 remains the same as with the previously described embodiments. From a second suction or intake opening 38, an intake channel 39 extends tangentially in the upper region of the turbine chamber 17 and is followed by a similarly nearly tangential discharge channel 40 that opens out into the brush chamber 3. An air feed channel 42 that is formed from a forward portion 41 and a rear portion 43 extends tangential to the turbine chamber 17 in the lower region and thus connects the brush chamber 3 with the connection chamber 28 via the interposition of the turbine chamber 17. The intake air conveyed through the connector 9 is drawn in not only through the first intake opening 19 but also through the second intake opening 38, whereby the turbine 10 is driven by the air streams of the intake channel 39 and the forward portion 41 of the air feed channel 42, which air streams tangentially strike the turbine wheel 11, thereby rotating the brush roller 4. The air stream that is guided in the upper portion of the turbine chamber 17 through the discharge channel 40 passes into the brush chamber 3 and flows about the brush roller 4, thereby loosening dust particles that are disposed between the bristles 5, with these dust particles that have been loosened from the brush roller being carried along with the dust-laden air through the air feed channel 42.

Figure 6:
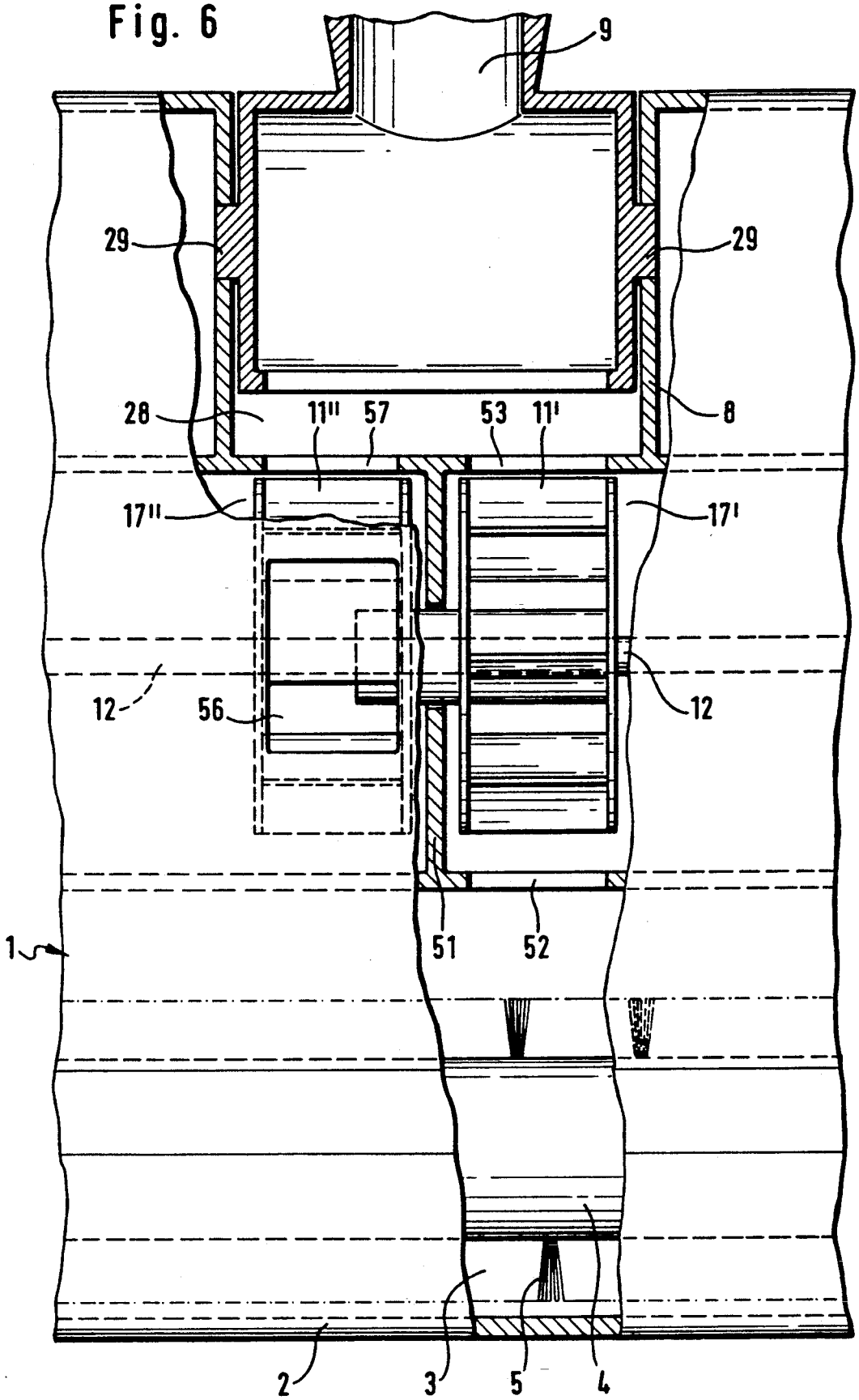
FIG. 6 is a partially cross-sectioned view from above of a nozzle mechanism having two turbine wheels that are disposed in separate turbine chambers.

FIG. 6 is a partially broken away and cross-sectioned plan view of a portion of the middle region of a vacuum cleaner nozzle mechanism 1. In this embodiment, the connector 9 is mounted in the suction conduit receiving means 8 via laterally disposed pins or journals 29. Disposed between the brush chamber 3 and the connection chamber 28 are two turbine chambers 17' and 17" that are disposed next to one another and are separated from one another by a partition 51. From a flow standpoint, the turbine chambers 17' and 17" are parallel to one another and are provided with turbine wheels 11' and 11" of equal size. The turbine wheels are disposed on a common shaft 12, so that both of the turbine wheels rotate simultaneously and at the same speed, regardless through which of the turbine chambers 17' and 17" air is flowing at any given point in time. The turbine chamber 17' communicates with the brush chamber 3 via an inlet opening 52 and with the connection chamber 28 via a discharge opening 53. Provided at the upper side of the nozzle mechanism 1 is an intake opening 56 that communicates with the second turbine chamber 17", which has a discharge opening 57 via which the air stream passes into the connection chamber 28. It is to be understood that the flow paths through the turbine chamber 17' and 17'' can be controlled by non-illustrated valve means in the manner described in conjunction with FIGS. 1 to 4.

The present invention is, of course, in no way restricted to the specific disclosure of the specification and drawings, but also encompasses any modifications within the scope of the appended claims.

I claim:

1. In a vacuum cleaner nozzle mechanism having a sliding base with a first intake opening, a suction conduit connecting means for a vacuum cleaner, an air feed channel for establishing communication between said first intake opening and said connecting means, and a turbine that is driven by drawn-in air and serves to drive a brush roller that is rotatably mounted in the vicinity of said first intake opening, the improvement wherein:

a second intake opening is provided, with an intake channel that is independent of said first intake opening establishing communication between said second intake opening and a turbine chamber for said turbine, with said air for driving said turbine being supplied to said turbine chamber at least partially via said second intake opening and said intake channel, with said air feed channel, which conveys dust-laden air, being disposed between said first intake opening and said turbine chamber, with said air feed channel and said intake channel opening out into said turbine chamber on one and the same side thereof.

2. A nozzle mechanism according to claim 1, which includes a discharge channel that leads from said turbine chamber into a connection chamber that, when viewed in a direction of air flow, is disposed immediately upstream of said connecting means.

3. A nozzle mechanism according to claim 2, in which said air feed channel, which conveys dust-laden air, bypasses said turbine chamber and opens out into said connection chamber.

4. A nozzle mechanism according to claim 1, which includes valve means disposed in a flow path of at least one of said intake channel and said air feed channel.

5. A nozzle mechanism according to claim 4, in which said valve means is embodied in such a way that a reduction of a passage cross-section of said intake channel effects a commensurate enlargement of a passage cross-section of said air feed channel.

6. A nozzle mechanism according to claim 5, in which said valve means is embodied as a slide mechanism that is movable transverse to said air feed channel.

7. A nozzle mechanism according to claim 6, wherein said air feed channel opens into said turbine chamber via an opening that is disposed in a common plane with an opening via which said intake channel opens into said turbine chamber, and wherein said slide mechanism has an opening and thereby acts as an adjustable orifice plate for said passage cross-section of said intake channel.

8. A nozzle mechanism according to claim 5, in which said valve means is embodied as an element that is pivotable along part of a circular arc.

9. A nozzle mechanism according to claim 1, in which said turbine comprises two turbine chambers, each of which is provided with a turbine wheel, with one of said turbine wheels receiving driving air from said intake channel, and the other of said turbine wheels receiving driving air from said air feed channel.

10. A nozzle mechanism according to claim 9, in which said turbine wheels are disposed on a common shaft that is mounted in a partition that separates said turbine chambers from one another.

11. In a vacuum cleaner nozzle mechanism having a sliding base with a first intake opening, a suction conduit connecting means for a vacuum cleaner, an air feed channel for establishing communication between said first intake opening and said connecting means, and a turbine that is driven by drawn-in air and serves to drive a brush roller that is rotatably mounted in the vicinity of said first intake opening, the improvement wherein:

a second intake opening is provided, with an intake channel that is independent of said first intake opening establishing communication between said second intake opening and a turbine chamber for said turbine, with said air for driving said turbine being supplied to said turbine chamber at least partially via said second intake opening and said intake channel, wherein said air feed channel, which conveys dust-laden air, is disposed between said first intake opening and said turbine chamber, with said air feed channel and said intake channel opening out into said turbine chamber on opposite sides thereof and both being guided in a nearly tangential manner through said turbine chamber.

12. A nozzle mechanism according to claim 11, in which said turbine chamber has a discharge portion that discharges air out of said turbine chamber and into a chamber for said brush roller.

13. A nozzle mechanism according to claim 12, in which air that enters said brush chamber from said discharge portion of said intake channel flows about said brush roller and then flows together with dust-laden air through said air feed channel and into said connection chamber.

* * * * *